US007431564B2

(12) United States Patent
Newman

(10) Patent No.: US 7,431,564 B2
(45) Date of Patent: Oct. 7, 2008

(54) TURBINE BLISK

(75) Inventor: Andrew J. Newman, Bristol (GB)

(73) Assignee: Rolls Royce plc, London (GB)

( * ) Notice: Subject to any disclaimer, the term of this patent is extended or adjusted under 35 U.S.C. 154(b) by 599 days.

(21) Appl. No.: 11/101,444

(22) Filed: Apr. 8, 2005

(65) Prior Publication Data

US 2005/0232780 A1 Oct. 20, 2005

(30) Foreign Application Priority Data

Apr. 16, 2004 (GB) ..... 0408497.6

(51) Int. Cl.
*B63H 1/16* (2006.01)

(52) U.S. Cl. ..... 416/193 A; 416/198 A; 416/213 R

(58) Field of Classification Search ..... 416/213 R, 416/193 A, 95, 198 A; 29/889.22
See application file for complete search history.

(56) References Cited

U.S. PATENT DOCUMENTS 3,588,276 A * 6/1971 Jubb ..... 416/95
3,606,573 A * 9/1971 Emmerson et al. ..... 416/90 R
4,096,615 A 6/1978 Cross
4,152,816 A 5/1979 Ewing et al.
4,270,256 A 6/1981 Ewing
4,767,274 A * 8/1988 Walter ..... 416/193 A
4,784,573 A * 11/1988 Ress, Jr. ..... 416/213 R
5,273,708 A 12/1993 Freeman

FOREIGN PATENT DOCUMENTS

GB 2 372 784 A 9/2002
JP A 59-069479 4/1984

* cited by examiner

*Primary Examiner*—Igor Kershteyn
(74) *Attorney, Agent, or Firm*—Oliff & Berridge, PLC

(57) ABSTRACT

A blisk for use in the turbine section of a gas turbine engine comprises a disk around the circumference of which is disposed a plurality of blades in an annular array. The blades are preferably cast separately and then joined, for example by welding, so that the roots form a continuous ring. The remaining volume of the rotor disk is formed of consolidated metal powder by a hot isostatic process. Extending a short distance above each blade root is a shank carrying a platform and the blade airfoil section. The dimensions of the platforms in the circumferential direction are such that they co-operate to form a plenum chamber encircling the periphery of the rotor disk. The blades are cast with internal cooling passages access to which is gained from the plenum through orifices in the sides of the blade shanks. Thus, in use, cooling air may be passed across at least one face of the blisk into the plenum from where it enters the blade cooling passages.

6 Claims, 2 Drawing Sheets

TURBINE BLISK

BACKGROUND

1. Field of the Invention

The invention relates to a turbine blisk. In particular it concerns the manner in which a turbine blisk may be manufactured.

2. Description of Related Art

The term blisk is a contraction of the two words "bladed disk" and is used in the field of gas turbine engines to refer to a unified assembly of a turbine disk together with a circumferential array of turbine blades. It may be used in the case either where the whole assembly has been machined from a single piece of metal or where the supporting disc and the blades have been irreversibly joined, for example by welding. "Single piece of metal" shall be taken for present purposes to include a metal article, such as the turbine disc, made from metal powder, which has been joined into a whole by a hot isostatic bonding process.

The use of powder metallurgy for manufacturing blisks for use in gas turbines is well known in the art and has been described in numerous publications. None of the publications has discussed solutions to the problems associated with heating of the disc head as a result of exposure to the main hot gas flow. No blisk so manufactured has incorporated cooling into the turbine aerofoil. So it has been accepted, until now, that the use of Blisks is restricted to compressors because turbine sections are too hot.

Current manufacturing processes and designs do not allow for the blades or the rim of the rotor disc to be cooled. Current designs use the platforms of the rotor blades to form the outer annulus of the rotor disc. Therefore, in practice, the engine main hot gas heats the platforms and consequently the rim of the disc. This results in lower mechanical properties and limited life of the part due to creep failure. In the absence of provisions to cool the blades internally, the use of the design and the operating temperature of the rotor blades is further limited. This imposes a maximum limit on the operating temperature of blisks so designed and made, and particularly precludes the use of this type of blisk in turbines. An objective of the present invention is to overcome these drawbacks. Further advantages will be apparent in the following description of the invention.

SUMMARY

The present invention seeks to overcome the above mentioned drawbacks by utilising the root section of individually cast blades instead of the platform to form a hoop continuous ring, which thereby forms the head of the disc, shielding the remainder of the disc.

According to one aspect of the present invention there is provided a blisk comprising a disc having a periphery, a plurality of blades spaced apart around the periphery of the disc, each of said blades consisting of shank and an airfoil section which extends outwardly from the periphery of the disc in a generally radial direction, each airfoil blade section is formed with internal cooling passages which communicate with at least one orifice in the blade shank and has a circumferentially extending platform lying between the shank and the airfoil blade section, wherein the platforms extend towards each other in a circumferential direction and confronting edges of neighbouring blades are sealed one to another to form a substantially continuous ring spaced a radial distance above the periphery of the disc such that between each pair of neighbouring shanks there is defined a plenum chamber containing the blades shanks, with which the internal cooling passages of the blades communicate.

In one form of the invention each of said blades further consists of a root section wherein the dimensions of the roots in the in the direction of the disc circumference are such that neighbouring roots abut to form a continuous ring defining the periphery of the disc.

According to a further aspect of the present invention a method of manufacturing the blisk comprises the steps of forming a plurality of blades, each blade having a root the dimensions of which are such when the blades are disposed in a circular array the roots of each blade abuts its neighbours, disposing the blades in such a circular array and joining adjacent blades to form a continuous ring defining the periphery of the disc.

The invention and how it may be carried into practice will now be described by way of example only with reference to an example illustrated by the accompanying drawings, in which:

DETAILED DESCRIPTION OF EMBODIMENTS

Figure 1:
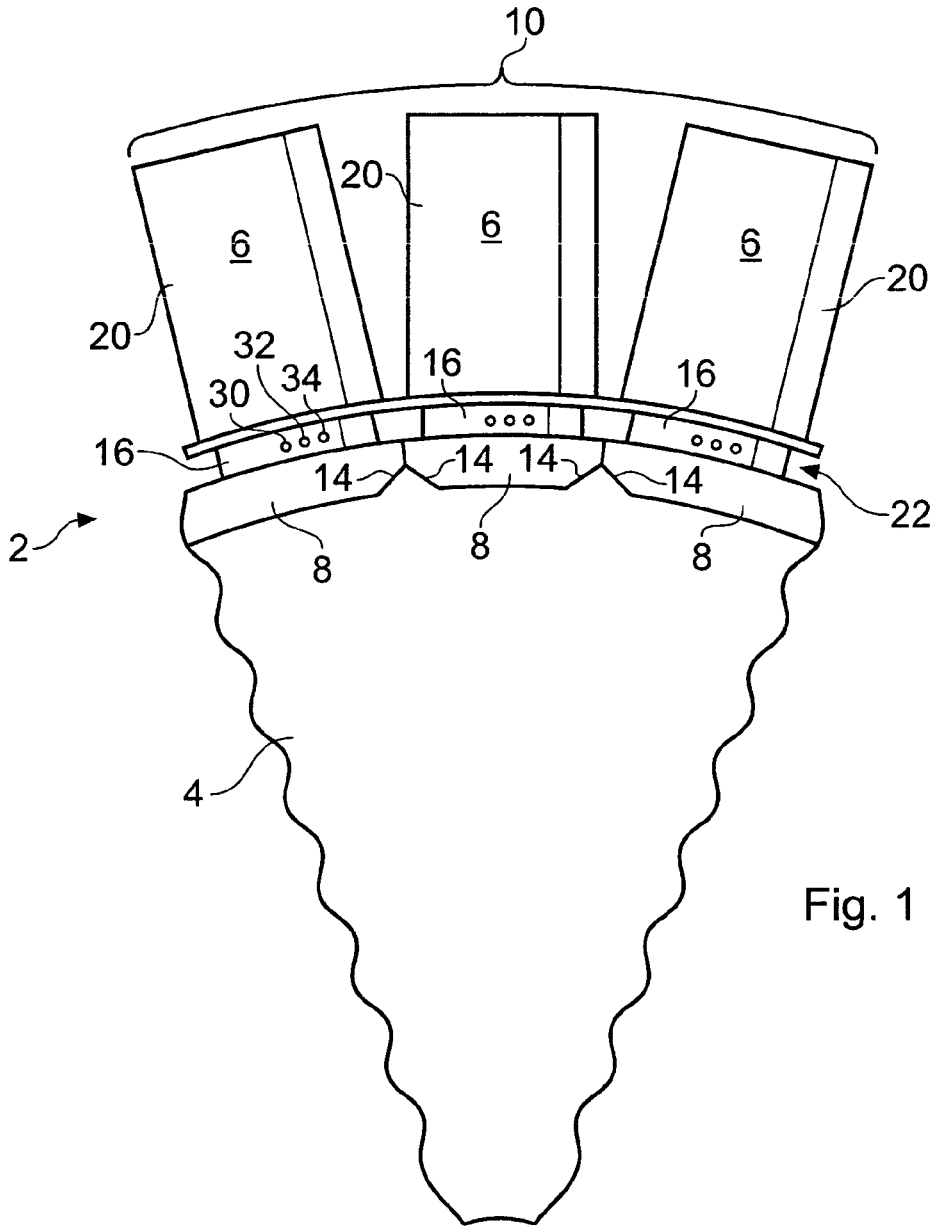
FIG. 1 shows an axial view of the front face of a sector, embracing three blades, of a Blisk in the direction of arrow A in FIG. 2.

Referring now to the drawings there is shown a single rotary stage of an axial flow compressor in the form of a Blisk 2. The defining characteristic of a Blisk, a contraction of the words Bladed disk, is that the rotor disk 4 and the whole set of rotor blades 6 are either formed integrally, for example by machining from solid, or are formed separately and then permanently joined together, for example by welding.

In a conventional rotor assembly with dismountable blades, the blades are cast or forged, with an airfoil section upstanding from a platform and below the platform a shank and a root section. The edges of the platforms are profiled to abut opposite edges of neighbouring platforms when the blades are assembled onto the periphery of the rotor disk. The roots are shaped to engage axially extending dovetail slots in the rim of the disk. Another method of mounting blades comprises a circumferentially extending profiled slot in the disk rim; the blade roots are complementarily shaped and are inserted through a keyhole and slid around the slot until the platforms abut. The slot profile and root shape retain the blades in position.

Both these known methods of mounting the blades allow cooling air to enter internal air-cooling passages in the blades through orifices in the blade roots, under the platforms. Before entering the blade roots the cooling air path may be arranged to draw the air across the face of the rotor disk thereby cooling it. Also when the blades are assembled in a ring the blade platforms form a complete annulus shielding the disc head from the temperature of the main gas path. This has the advantage of permitting the disc rim to be spaced from the blade platforms, and the passage of cooling air across the face of the disc provides convection cooling for the disc head, thereby reducing its operating temperature and optimising its mechanical properties.

Hitherto Blisk designs and manufacturing methods have precluded internal blade cooling so that the high operating temperatures of the turbine have prevented their use in hot turbine sections. It is an objective of the present invention to allow the use of Blisks in high-pressure (HP) and low-pressure (LP) turbine rotor stages by allowing blades to be cooled internally and the disc to be cooled.

By current manufacture Blisks may be cast as a single unit or machined from solid, with the airfoil sections of the blades upstanding from the rim of the disk. This kind of arrangement effectively precludes internal cooling of the blades so the head of the disk is subject to operating temperatures closer to the main gas path temperatures. As a result of the higher operating temperature the mechanical strength of the Blisk is reduced.

In accordance with the present invention a blisk 2 comprises a disc 4 around the circumference of which is disposed a plurality of blades 6 in an annular array. The blades 6 are formed separately from the disc 4, preferably by casting, although other methods are not excluded. It follows also that the disk 4 and blades 6 are not necessarily manufactured of identical materials, of which more below. The blades 6 are then joined one to another in an annular array. It is preferred to cast the blades individually and to subsequently join them together. However, it is to be understood that it is intended that the invention shall also include blades cast in groups comprising more than one.

Each blade 6 is formed with the dimensions of its root 8 in the direction of the circumference of disk 4 such that the roots 8 of adjacent blades 6 abut. During the manufacturing process, abutting roots are joined to form a continuous ring defining the periphery of the disc 4. In a situation where blades are formed in groups of more than one blade this shall include the possibility that the roots of some neighbouring blades are formed integrally. Part of this ring of blades is indicated at 10 in FIG. 1. In the embodiment being described the roots 8 of blades 6 are joined permanently by welding but in other examples other methods of joining such as brazing may be employed.

As shown in FIG. 1 the roots 8 have a constant radial depth over most of their circumferential length, except at the edges 14 which abut the root 8 of a neighbouring blade. Here the edges 14 are chamfered, or tapered, to a depth at which the margins of the roots may be easily welded together. Preferably the depth of these edges 14 is such that the joint region may be penetrated at a single weld pass from one side, without generating sufficient heat to cause distortion of the roots 8 at the weld margins. Where the joints are formed by brazing a short depth is also desirable to help to ensure the joints are easily and successfully brazed.

In such an annular assembly, the roots 8 of the blades 6 project radially inwardly towards the centre of the disk 4, which is also the centre of the blade ring 10. Thus the roots 8 occupy part of the volume of the rotor disk 4, and when joined in the blade ring present an inward facing profile of depth, which varies around the annulus due to the chamfered edges 14 of the blade roots 8. As the remaining volume space of disk 4 is filled with metal powder, the spaces between the chamfered edges 14 is also filled. When the space between HIPping die parts is filled the whole is consolidated into a single mass by a hot isostatic pressing (HIP) process.

In a preferred arrangement, illustrated in the drawings, each blade 6 has a shank 16 that extends outwardly from the root 8 and carries a blade platform 18 upon which is mounted the airfoil blade section 20. The dimensions of the blade platforms 18 in the direction of the disk circumference are such that the platforms 18 form a substantially continuous ring spaced a radial distance above the periphery of the disk 4. This defines an annular plenum chamber 22 encircling the disk 4 and containing the blades shanks 16.

The dimensions of the blade platforms 18 in the circumferential direction may be sufficient that adjacent platform edges abut one another in which case they may be joined permanently such as by welding or brazing as previously described. Alternatively, adjacent platform edges may be sealed using, for example, seal strips of the kind used to seal gaps between guide vanes assemblies. The faces of each pair of confronting platform edges are formed with longitudinally extending slots into which is fitted an elongate metal strip. Although the strip is trapped in the slots it is free to move a small amount so that when, in operation, there is a pressure difference across the gap the strip is urged against the edges of the slots to seal the gap. When all the blades are assembled together with such seal strips between each pair of platforms they effectively form a continuous ring.

Figure 4:
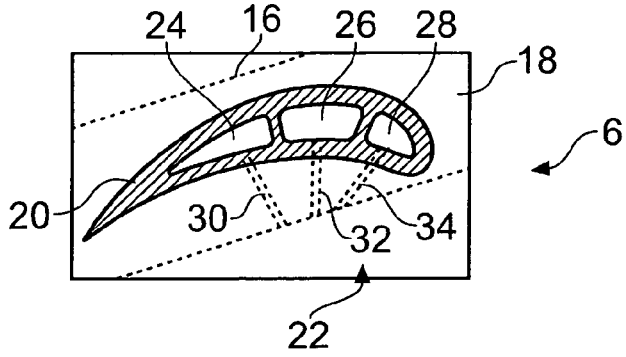
FIG. 4 shows a view of a blade in the direction of arrow C in FIG. 1.
Figure 3:
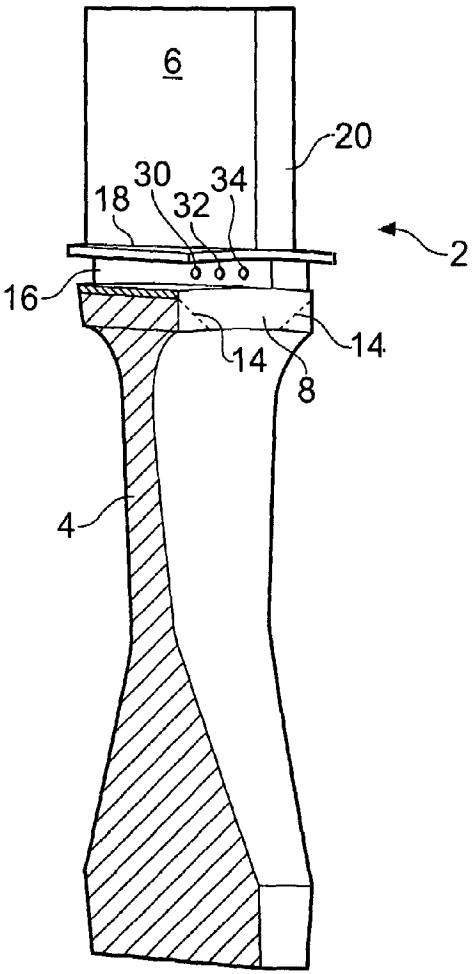
FIG. 3 shows an isometric view of a single blade sector of the disc of FIGS. 1 and 2.
Figure 2:
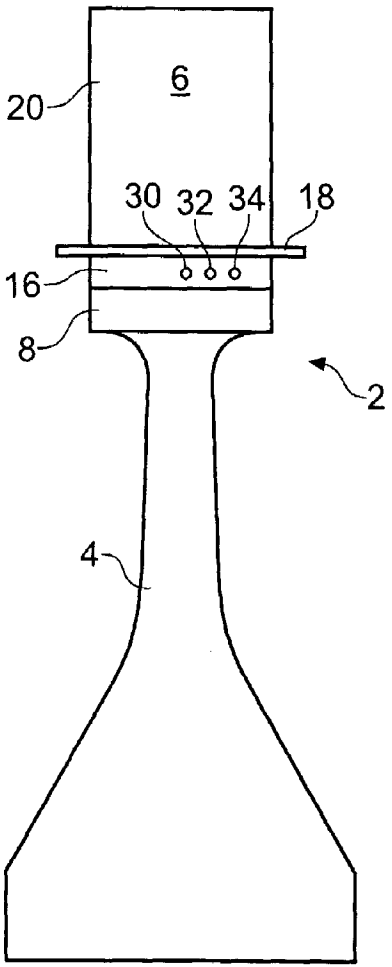
FIG. 2 shows an axial section at B-B of the disc of FIG. 1.

In embodiment, as shown in FIG. 4, the airfoil section 20 of each of the blades 6 is formed with internal cooling passages 24,26,28 that communicate with the plenum chamber 22 through at least one orifice formed in the blade shank 16. Here three such cooling entry orifices 30, 32, 34 are shown leading into the passages 24, 26, 28 respectively. It is to be understood that the arrangement illustrated is indicative only and is not intended to represent a working arrangement, for example cooling exit holes are not depicted. Suitable practical arrangements will be familiar to those skilled in the art of turbine blade cooling.

A preferred method of manufacturing a blisk of the kind described above comprises the steps of forming a plurality of blades 6, which may be cast with internal cooling passages. The blades are each cast with a root 8 the dimensions of which are such when the blades 6 are disposed in a circular array the roots of each blade abuts its neighbours. The blades are then temporarily clamped in a circular array, and adjacent blades are welded together to form a continuous ring 10.

As previously mentioned this blade ring defines the periphery of the rotor disk. The ring is then located between hollow die parts defining the two opposite side faces of the rotor disk. The rotor disk is formed by a HIPping process, in which the closed volume is filled with metal powder, and the blade roots and powder disk are consolidated into an integral mass by a hot isostatic pressing process. As mentioned above the materials used for these parts need not be the same; so for example the blades 6, including the blade roots 8, may be cast from a nickel alloy known as MAR-M-002 preferred for turbine applications, while a nickel alloy powder known as UDIMET 720 is used to form the HIPped disk 4.

Thus the blade platforms 18 are spaced a short distance above the rim of disk 4 and a portion of the blade shank 16, that is the part lying between the blade root 8 and the blade platform 18, protrudes above the rim of the rotor disk. There is thus created the annular plenum space 22 under the ring of blade platforms 18.

As previously described this annular space under the blade platforms 18 is utilised as a plenum chamber 22 for collecting cooling air which may then be used to cool the turbine blades 6 through orifices formed in the blade root shank 16 and through internal passages 24, 26, 28 in the aerofoil in known manner. In casting the blades 6 the internal cooling passages 24-28 and 30-34 are created by the use of ceramic cores (not shown) which are subsequently leached out leaving the internal passages and cavities.

As is known in existing Blisk assemblies adjacent rotor stages may be joined together to form a drum, or the rotors may be joined to a common shaft for co-rotation. In either case cooling air is sourced from the region of the centre axis of the engine along an axial pathway. Cooling air then passes radially outwards over the face of the Blisk rotor and cools the disc head.

I claim:

1. A blisk comprising a disc having a periphery, a plurality of blades spaced apart around the periphery of the disc, each of said blades consisting of shank and an airfoil section which extends outwardly from the periphery of the disc in a generally radial direction, each airfoil blade section is formed with internal cooling passages which communicate with at least one orifice in the blade shank and has a circumferentially extending platform lying between the shank and the airfoil blade section, wherein each of said blades further comprising a root section, wherein the dimensions of the roots in the direction of the disc circumference are such that neighbouring roots abut to form a continuous ring defining the periphery of the disc, and wherein the platforms extend towards each other in a circumferential direction and confronting edges of neighbouring blades are sealed one to another to form a substantially continuous ring spaced a radial distance above the periphery of the disc such that between each pair of neighbouring shanks there is defined a plenum chamber containing the blades shanks, with which the internal cooling passages of the blades communicate.

2. A blisk as claimed in claim 1 wherein the blades are formed separately from the disc, the disc is formed of metal powder, and the whole is consolidated into an integral mass by a hot isostatic pressing process.

3. A blisk as claimed in claim 2 wherein the blades are cast.

4. A blisk as claimed in claim 1 wherein the blades are cast.

5. A blisk as claimed in claim 1 wherein neighbouring blade platforms are sealed one to another by a joining process.

6. A blisk as claimed in claim 1 wherein neighbouring blade platforms are sealed one to another by a seal strip.

* * * * *